US008011435B2

(12) United States Patent
Carossino et al.

(10) Patent No.: US 8,011,435 B2
(45) Date of Patent: Sep. 6, 2011

(54) SUBSEA LATERAL DRILLING

(75) Inventors: Ricardo Carossino, Chatou (FR); Andrea Sbordone, Costa Del Sol (SG); Henri Denoix, Clamart (FR); Charles Deible, Sugar Land, TX (US); Rene Schuurman, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 171 days.

(21) Appl. No.: 12/233,622

(22) Filed: Sep. 19, 2008

(65) Prior Publication Data

US 2009/0078424 A1 Mar. 26, 2009

(30) Foreign Application Priority Data

Sep. 20, 2007 (EP) ..... 07116811

(51) Int. Cl.
*E21B 7/12* (2006.01)

(52) U.S. Cl. ..... 166/358; 166/339; 166/352; 166/367; 166/368; 166/77.1; 175/5; 175/61; 405/224.3

(58) Field of Classification Search ..... 166/358, 166/339, 341, 344–347, 351, 352, 367–369, 166/381, 384, 385, 77.1, 77.2; 175/5–10, 175/61, 62, 213, 217; 405/183.5, 224.2, 405/224.3

See application file for complete search history.

(56) References Cited

U.S. PATENT DOCUMENTS

| | | | | |
|---|---|---|---|---|
| 5,394,951 | A * | 3/1995 | Pringle et al. | 175/61 |
| 5,720,356 | A * | 2/1998 | Gardes | 175/62 |
| 6,296,066 | B1 * | 10/2001 | Terry et al. | 175/92 |
| 6,305,469 | B1 * | 10/2001 | Coenen et al. | 166/250.01 |
| 6,318,480 | B1 * | 11/2001 | Hearn | 175/61 |
| 6,386,290 | B1 * | 5/2002 | Headworth | 166/346 |
| 6,691,775 | B2 * | 2/2004 | Headworth | 166/77.2 |
| 6,834,724 | B2 * | 12/2004 | Headworth | 166/384 |
| 6,923,273 | B2 * | 8/2005 | Terry et al. | 175/45 |
| 6,995,899 | B2 * | 2/2006 | Aronstam | 359/333 |
| 7,134,512 | B2 * | 11/2006 | Head | 175/61 |
| 7,172,038 | B2 * | 2/2007 | Terry et al. | 175/45 |
| 7,401,665 | B2 * | 7/2008 | Guerrero et al. | 175/61 |
| 7,487,846 | B2 * | 2/2009 | Head et al. | 175/61 |
| 2005/0252688 | A1 * | 11/2005 | Head et al. | 175/61 |
| 2006/0042835 | A1 * | 3/2006 | Guerrero et al. | 175/61 |

FOREIGN PATENT DOCUMENTS

| | | |
|---|---|---|
| WO | WO0043632 | 7/2000 |
| WO | WO2004003338 | 1/2004 |
| WO | WO2004011766 | 2/2004 |

* cited by examiner

*Primary Examiner* — Thomas A Beach
*Assistant Examiner* — Matthew R Buck
(74) *Attorney, Agent, or Firm* — Jianguang Du

(57) ABSTRACT

A method for drilling a borehole in a producing subsea wellbore wherein a flexible conduit is connected at one end to a surface vessel and at the other end via a pressurized subsea wellhead to the producing wellbore such that a remotely operated electrical drilling device (RODD) can be deployed down the flexible conduit, the method comprising:

directing a RODD to the location for drilling in the wellbore; and drilling a further wellbore section with the RODD;

wherein the drilling comprises drilling in underbalanced conditions with respect to the formation; and using fluids produced from the formation to transport the drill cuttings away from the drilling device.

12 Claims, 15 Drawing Sheets

SUBSEA LATERAL DRILLING

TECHNICAL FIELD

This invention relates to methods and system for drilling into existing wellbores. In particular for further drilling of producing subsea wellbores from light well intervention vessels.

BACKGROUND ART

There are a number of techniques that enable drilling of subsea wells. In conventional re-entry drilling of a subsea well, in order to access a subsea well a drilling rig is positioned above the well, a rigid riser and blowout preventor system are lowered into the sea and attached to a subsea wellhead. A drill string is lowered into the riser and well using the drilling rig hoisting system mounted on the drilling rig and then drilling can occur. Generally the cuttings produced during the drilling are brought to the surface using a direct continuous circulation process whereby drilling fluid is pumped down the drill string, comes out of the drill bit and returns to the drilling facility at the water surface through the annular space between the drill string and borehole then the annular space between the drill string and casing and finally the annular space between the drill string and the riser. A mud treatment system is then used to separate the drill cuttings from the drilling fluid which is then pumped down the drill string again, this is a continuous circulation process. However such conventional drilling operations require the use of expensive drill ships or floating rigs.

The present invention aims to provide a system to allow further drilling of existing subsea wellbores in an underbalanced mode from a surface vessel, such as a light intervention vessel.

DISCLOSURE OF THE INVENTION

A first aspect of the invention comprises a method for drilling a borehole in a producing subsea wellbore wherein a flexible conduit is connected at one end to a surface vessel and at the other end via a subsea wellhead to the producing wellbore such that a remotely operated electrical drilling device (RODD) can be deployed down the flexible conduit, the method comprising: directing a RODD to the location for drilling in the wellbore; and drilling a further wellbore section with the RODD; wherein the drilling comprises drilling in underbalanced conditions with respect to the formation; and using fluids produced from the formation to transport the drill cuttings away from the drilling device.

Preferably the method is for drilling a lateral borehole. The method allows for production of fluids from the existing wellbore to continue during the drilling of a further borehole. Hydrocarbon production is not stopped and the borehole can be drilled from the existing wellbore without the need to pull the production tubing from the wellbore. As the RODD can be deployed through the production tubing, there is no need to remove the production tubing before drilling. This saves time not having to remove the production tubing and a drilling rig is not required as the heavy production tubing is not removed from the borehole, therefore a vessel such as a light intervention vessel can be used instead. For underbalanced drilling, drilling fluid does not need to be pumped down from the surface, as the fluids produced during drilling are used to transport the cuttings away. As drilling fluid is not needed a drill pipe or any other fluid conduit extending from the surface vessel to the wellhead is not required. This allows the use of flexible tubing such as a flexible riser or SCG to deploy the drilling device from the floating platform to the wellhead, rather than a rigid riser. As a rigid riser or drill pipe from the surface to the wellhead is not required you are able to use a light well intervention vessel rather than the more expensive drill ships or semi submersibles vessels.

Preferably the method comprises pumping produced fluid over the cutting surfaces of the RODD and into the inside of the RODD. The produced fluid can cool the cutting surfaces of the drilling device in addition to transporting the drill cuttings away from the drilling device and up the production conduit. Using the reverse circulation mechanism of the RODD the fluid with cuttings can enter the RODD through the bit and travel up inside the RODD until the fluid with cuttings is discharged from the other end of RODD where it can then be carried up hole by the production fluid from the main borehole.

Preferably the method comprises lowering the RODD down the flexible conduit into the wellbore.

Preferably the method comprises lowering the RODD from a pressurised subsea wellhead into the wellbore. As the RODD is deployed down the flexible conduit and through the subsea well head into the wellbore the wellbore can continue to produce fluid.

Preferably the method comprises deploying the RODD from a light intervention vessel.

Preferably the flexible conduit is a spoolable compliant guide or a flexible riser.

A second aspect of the invention comprises a system for performing the method described above, the system comprising a flexible conduit connectable at one end to a surface vessel and at the other end to a subsea installation; and a remotely operated drilling device (RODD) capable of being inserted down the flexible conduit; wherein the RODD can be guided from the surface vessel down the flexible conduit into the existing subsea wellbore for further drilling from the subsea wellbore.

The system allows drilling in the wellbore to occur in underbalanced mode and without the need for a mud circulation system. As drilling fluid does not need to be introduced down the system and therefore a drill pipe from the surface vessel to wellbore is not needed, a flexible conduit can be used instead. Using the flexible conduit enables drilling of lateral boreholes from existing subsea wellbores without the need to use expensive drill ships or semi submersible type vessels.

Preferably the flexible conduit is a flexible riser or a spoolable compliant guide (SCG). The flexible conduit allows the RODD to be deployed through a pressurized wellhead.

The RODD can be attached to an umbilical and wireline assembly and the RODD preferably comprises a pump for pumping fluid over the cutting surfaces and into the inside of the RODD. An electrically operated pump, such as a suction pump is located in the RODD and facilitates a reverse circulation mechanism during drilling, such that the cuttings are drawn into the RODD via the pump and transported to the main borehole inside the RODD.

Preferably the surface vessel is a subsea light intervention vessel. Although the water surface vessel can also be a floating drilling rig, such as a semi submersible vessel or a drill ship.

BRIEF DESCRIPTION OF THE DRAWINGS

FIG. 1 shows insertion of the remotely operated drilling device (RODD) into the spoolable compliant guide (SCG);

FIGS. 2, 3 and 4 show the insertion process of the RODD into the subsea lubricator;

FIG. 5 shows the insertion of the RODD into the subsea blow out preventor (SSBOP);

FIG. 6 shows the flow of production fluid and cuttings during drilling when there is fluid flow from the main wellbore;

FIG. 7 shows the flow of production fluid and cuttings during drilling without fluid flow from the main wellbore;

FIG. 8 shows the fluid flow generated by mandrals;

FIG. 9 shows the fluid flow from the annular space via perforations in the production casing; and FIGS. 10-15 show the removal of the RODD from the wellbore through the SSBOP, subsea lubricator and SCG.

MODE(S) FOR CARRYING OUT THE INVENTION

Figure 1:
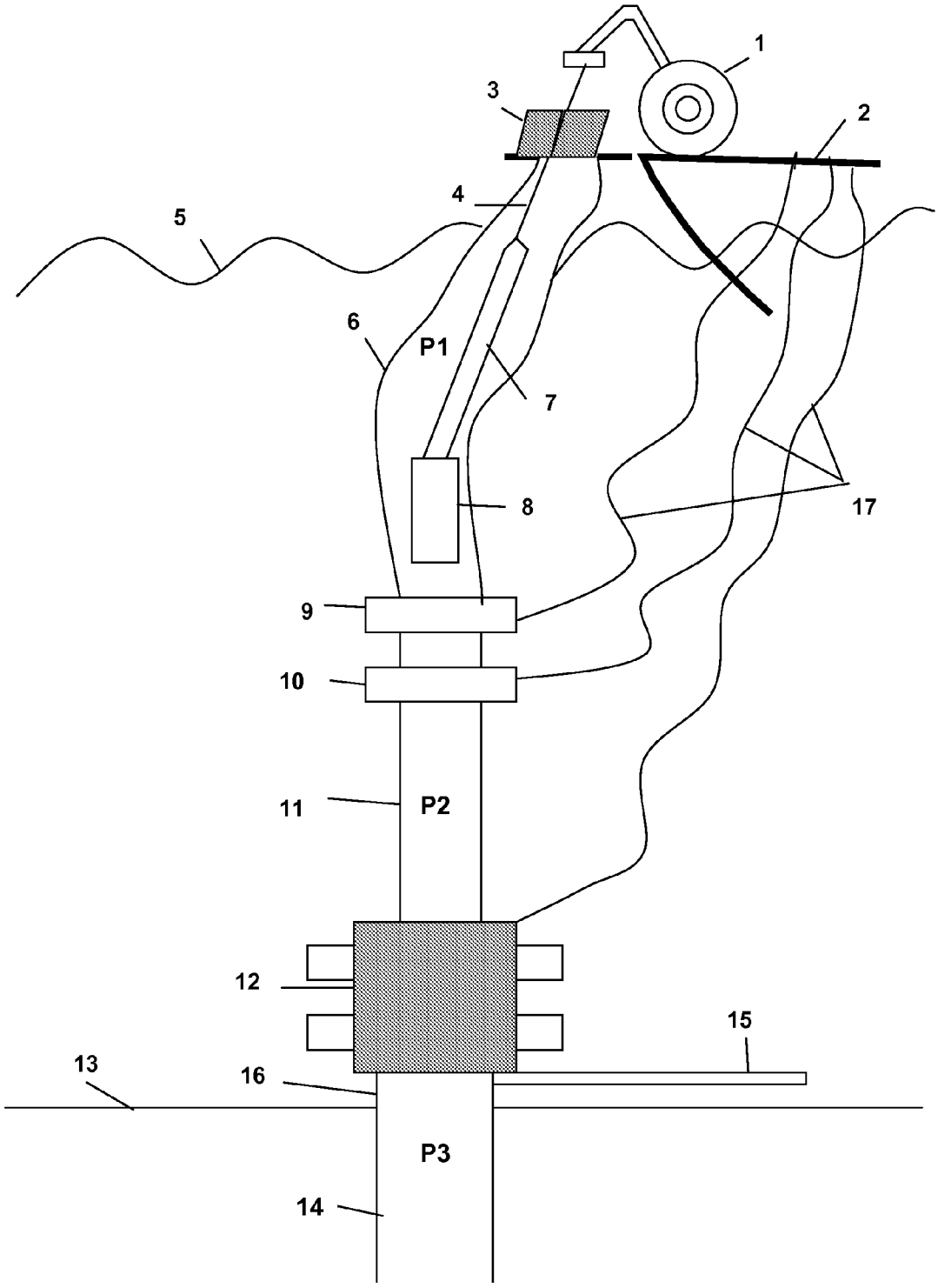
FIGS. 1-14 show a sequence of operation for drilling a borehole from an existing subsea wellbore.

One embodiment of the invention for deploying a remotely operated drilling device down an existing subsea wellbore is now described with reference to FIGS. 1-14, where the shaded components indicate that a seal of the system is active.

A floating platform 2, such as a light well intervention vessel, capable of deploying a spoolable compliant guide (SCG) 6 or a flexible riser, carries a wireline drum and injector unit 1 from which a remotely operated electrically controlled drilling device (RODD) 8 is deployed from. The RODD is attached to an umbilical 7 and the umbilical 7 is attached to the wireline cable 4. The umbilical is electrically and mechanically connected to the RODD and the wireline cable is electrically and mechanically connected to the umbilical. Alternatively the RODD may be attached to coil tubing. A vessel such as a light well intervention can be used as the production tubing does not need to be removed before the RODD is deployed down the wellbore, and therefore a drilling rig is not needed to lift the heavy production tubing from the wellbore.

A sub sea blowout preventor (SSBOP) 12 or well intervention package is deployed and secured to the subsea wellhead 16 on the seabed 13. The SSBOP is capable of creating a seal around the wireline of the RODD. A lubricator 11, capable of accommodating the length of the RODD 8, is attached to the SSBOP or well intervention package 12. The top of the lubricator has two remotely operated stuffing boxes 9, 10. One stuffing box 9 is capable of sealing against a wireline cable 4, and the other stuffing box 10 is capable of sealing against the umbilical 7. The stuffing boxes are capable of creating a pressurized tight seal around the umbilical and wireline cable attached to the RODD to prevent leakage of well fluids when the drilling device is deployed in the well. Control lines 17 electrically connect the SSBOP and stuffing boxes to the vessel to enable their seals to be actuated from the surface.

The SCG or flexible riser is attached to the lubricator at one end and a surface stuffing box on the light well intervention vessel at the other end. The SCG can comprise a hollow, continuous or jointed tube. Using a SCG or flexible riser allows a substantial distance to exist between the between the entry point at the surface 5 and the installation seal at the seabed 13 and enables the entry point to be positioned remote from the subsea installation as it assumes a compliant shape between the surface wireline lubricating system positioned on the floating vessel and the subsea installation allowing dynamic relative movement between them without the use of heave compensators. This allows for the subsea installations, i.e. the injector or lubricator, to have their control systems and wireline drum or coiled tubing reel located on the water's surface for ease of access and maintenance. The RODD has a maximum outer diameter that is smaller than the inner diameter of the spoolable compliant guide or flexible riser and smaller than the inner diameter of the production conduit to allow the drilling device to pass through the device and into the existing wellbore. The RODD can be of any sort such as that described in WO2004/011766.

Once the wellbore access system comprising the SCG or flexible riser, the lubricator and the SSBOP is installed, the RODD is lowered into the SCG using the cable and umbilical assembly from the floating vessel. FIG. 1 shows the start of the process of lowering the RODD into the SCG. The SSBOP is closed, this prevents any existing wellbore pressure from escaping the well which in turn is producing hydrocarbons through production line 15 which transports the production fluid to a production facility with fluids/solids separation capabilities (not shown). The wellhead can comprise pressure sensors to enable the pressure, P3, at the wellhead to be known.

The RODD 8 is then lowered into the lubricator 11. A surface stuffing box 3 is actuated to seal against the wireline cable. A pump on board the floating platform, is used to increase the internal pressure (P1 and P2) of the lubricator/SCG system so that the pressure P1 and P2 is increased to the same as the flowing wellhead pressure, P3, at the producing wellhead 16. At this stage the pressure in the SCG, P1, in the lubricator, P2, and in the, wellhead, P3, are equal.

Figure 2:
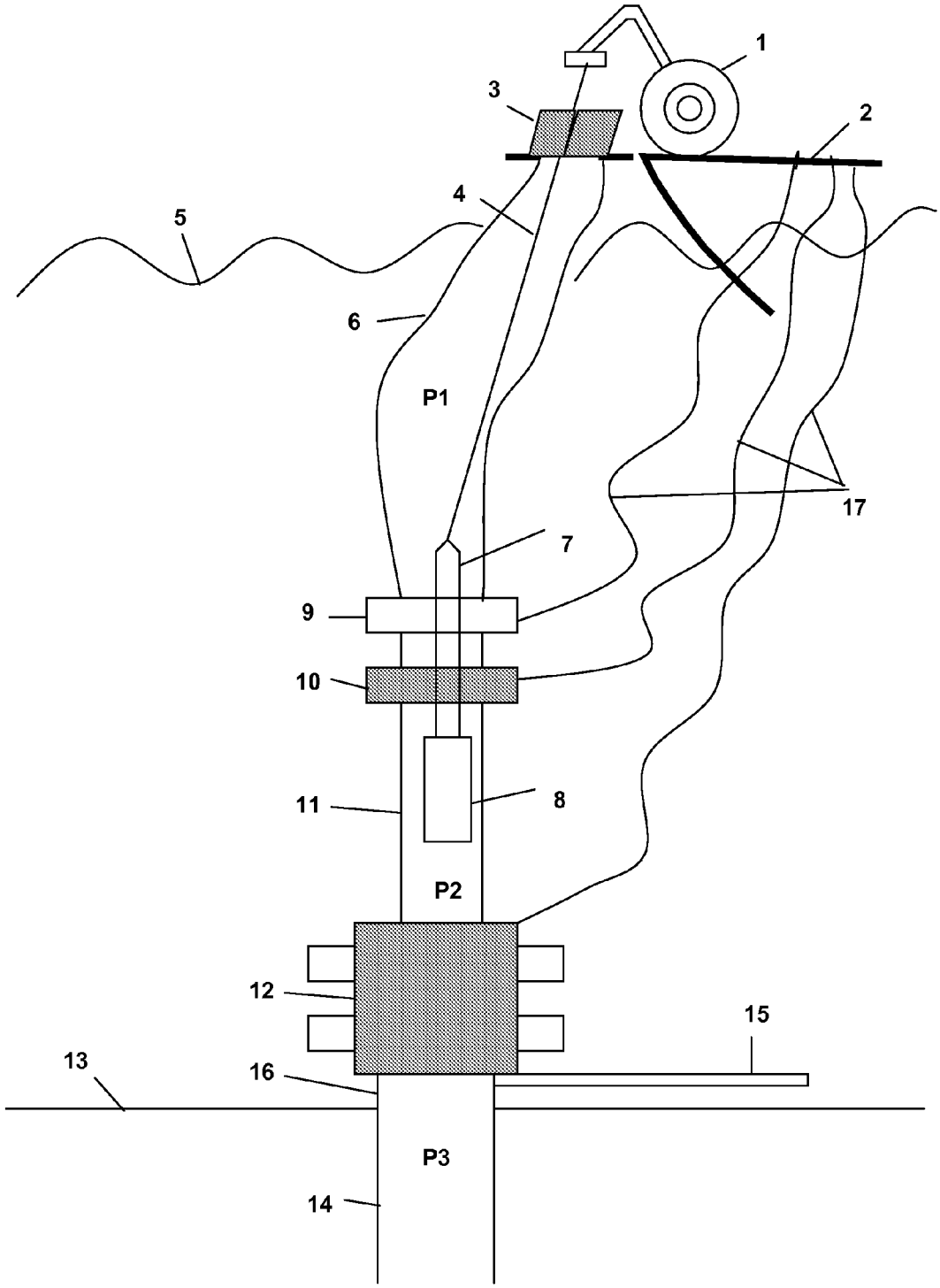

As shown in FIG. 2 the RODD is then lowered further down the SCG and stuffing box 10, located on the well access system, is actuated using a control line 17 to create a seal about the umbilical 7. The pressure, P1, in the SCG or flexible riser is increased such that it is greater than the pressure at the lubricator, P2, but still within the limits of the umbilical ratings so that the umbilical which straddles the lubricator 11 and SCG 6 over the stuffing box 10 does not bust or collapse. At this stage the pressure P1 in the SGC, is greater than the pressure P2, in the lubricator, and the pressure P3 at the wellhead, while the pressure P2 in the lubricator is equal to the pressure P3 at the wellhead.

Figure 3:
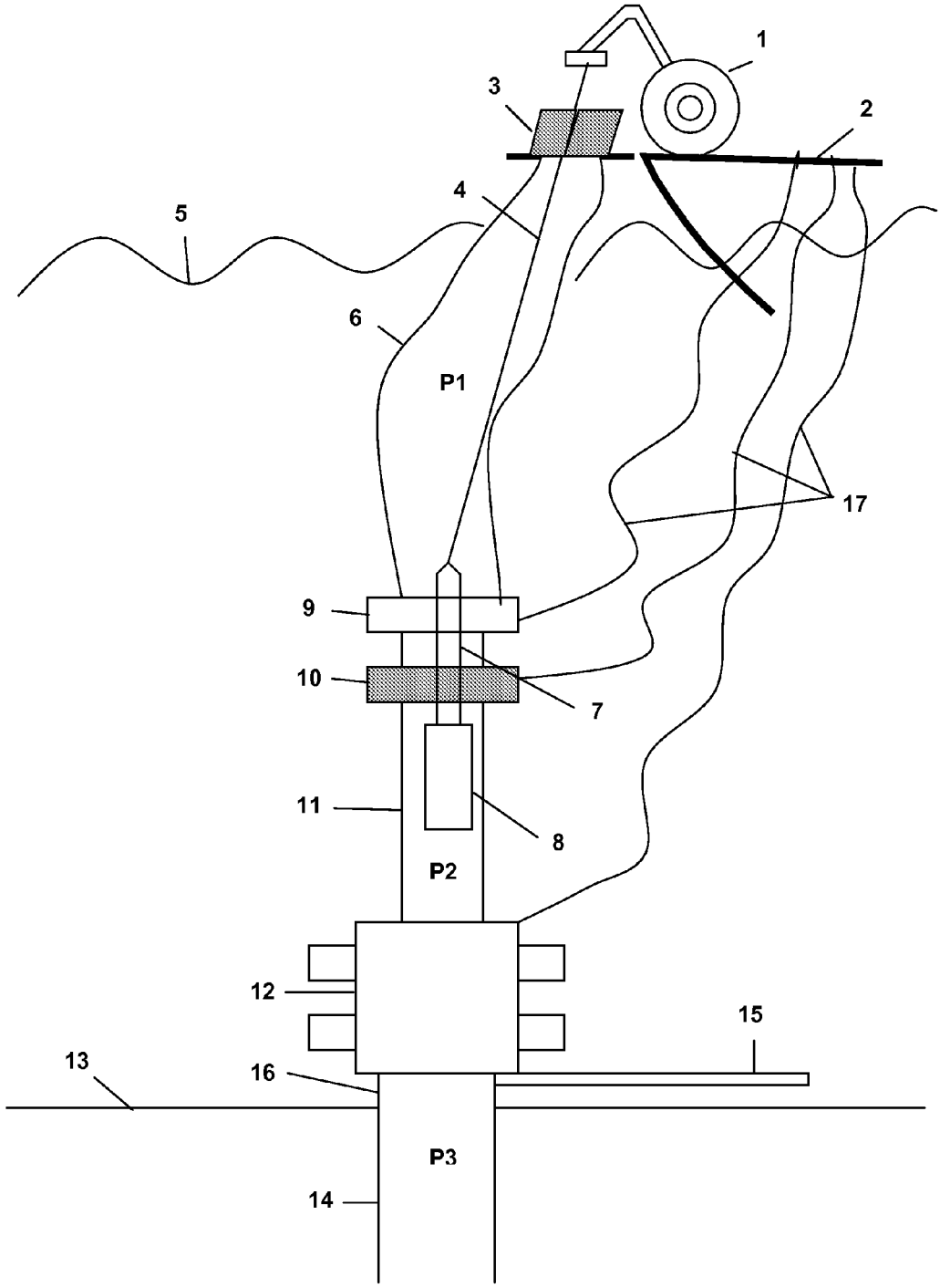

Once the pressure, P1, in the SCG is greater than the pressure, P2, in the lubricator, which in turn is equal to the pressure, P3, at the wellhead, the SSBOP can be fully opened and the RODD/umbilical and wireline assembly lowered into the wellbore 14, as shown in FIG. 3. Injection of the RODD/umbilical and wireline assembly is not required due to the pressure distribution in the system whereby P1>P2 and P3, and P2=P3.

Figure 4:
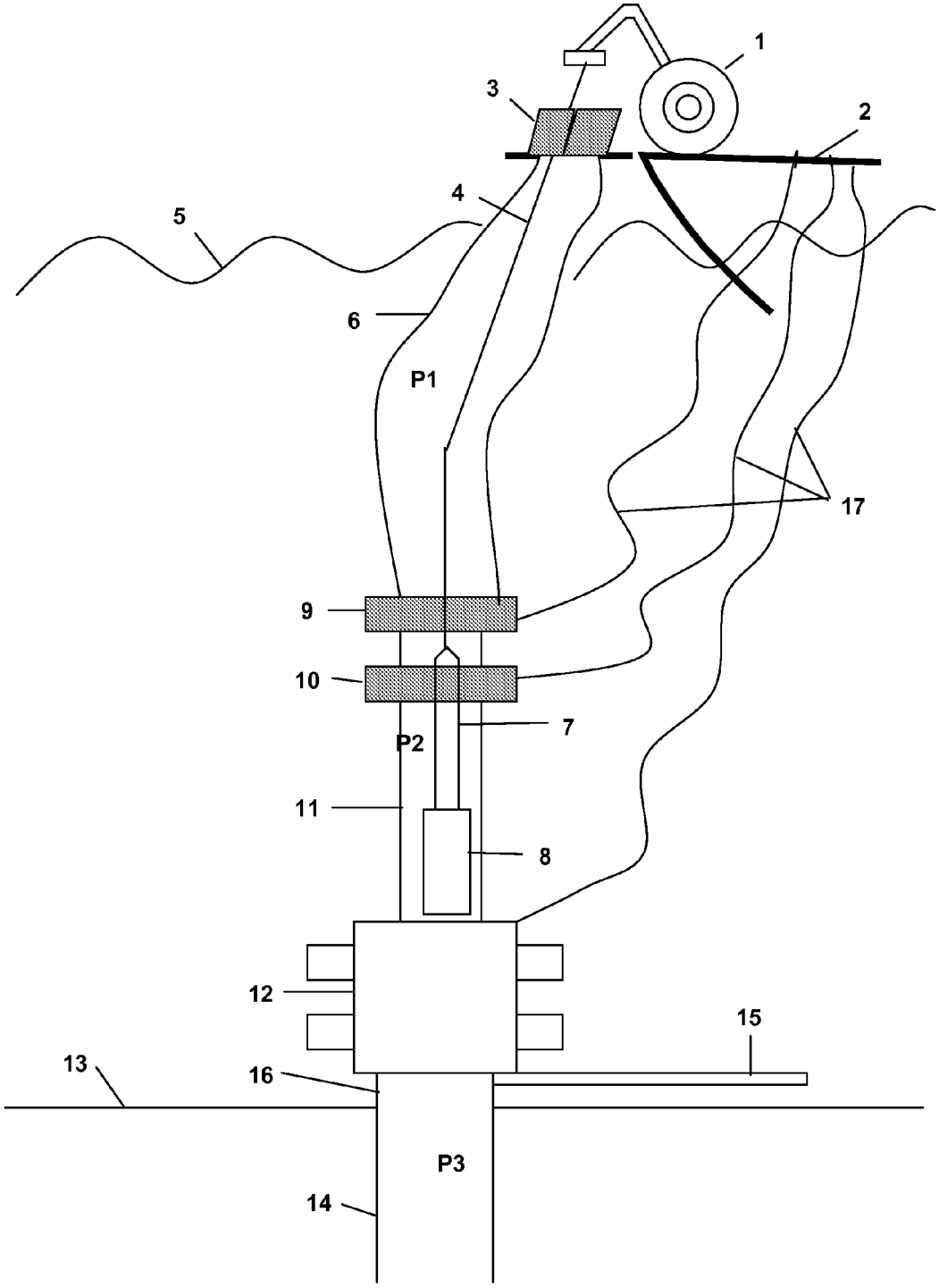
Figure 5:
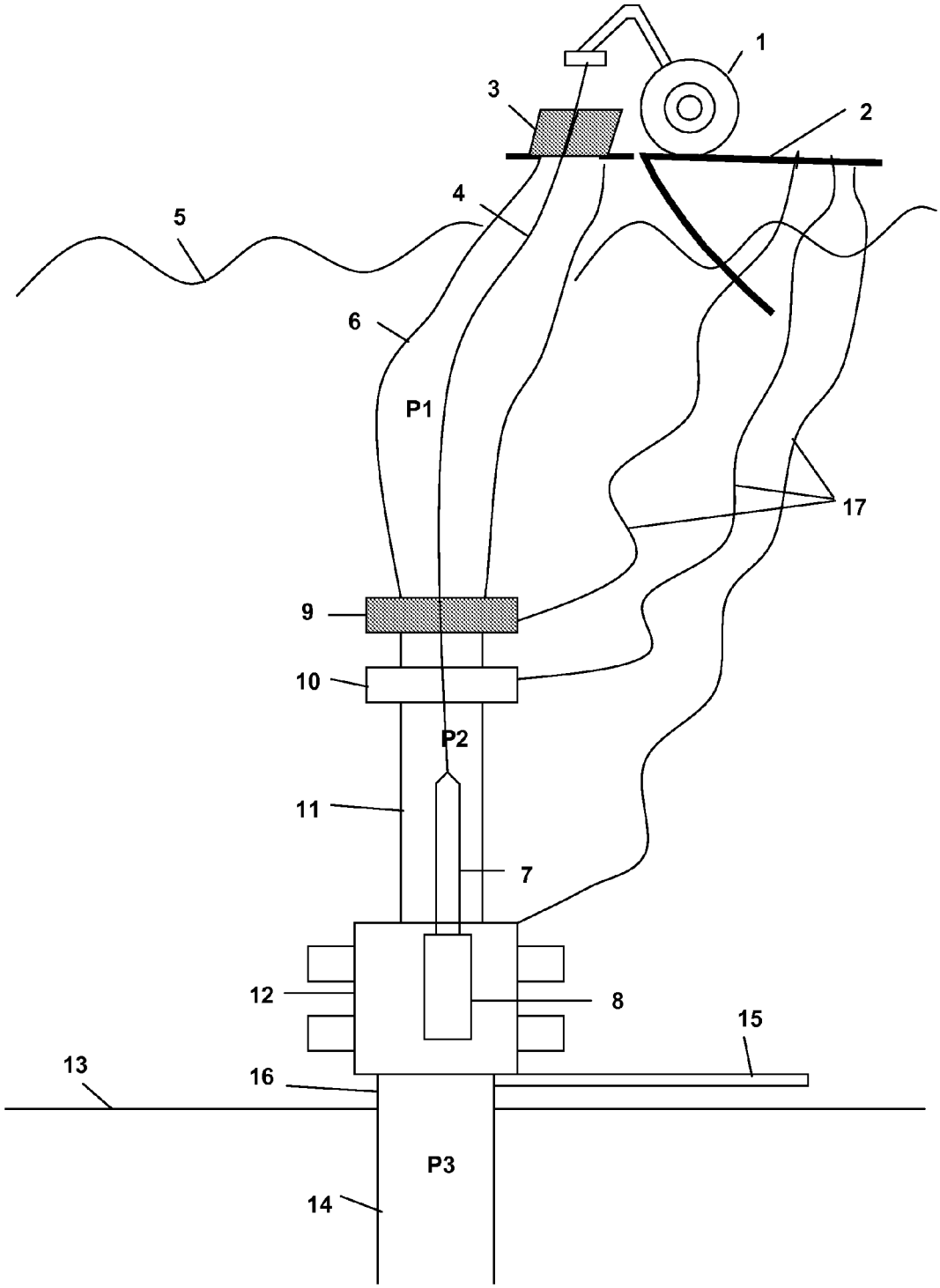

Once the lower end of the wireline cable reaches the top stuffing box 9, located in the well access system, it is actuated using one of the control lines 17 to seal about the wireline cable, see FIG. 4. Once the seal about the wireline cable is confirmed the control line 17 is used to deactivate stuffing box 10, see FIG. 5. This removes the seal between stuffing box 10 and the umbilical 7. In this configuration the pressure, P1, in the SCG or flexible riser is still isolated from the pressure, P2, in the lubricator by stuffing box 9 which has created a seal about the wireline cable.

The RODD is lowered into the wellhead and then down the wellbore 14 through the production tubing, that is still present in the wellbore. The RODD is then positioned at the point in the wellbore where drilling of a new lateral is desired and the drilling process can begin. The water or hydrocarbon fluid bearing zone is drilled through at a wellbore pressure below the formation fluid pressure, i.e. underbalanced drilling. During underbalanced drilling the hydrocarbons produced flow into the wellbore, and therefore the drilling equipment has to be designed to handle such flows. The RODD is operated such that the cutting surfaces on the device drill the borehole from the existing wellbore thereby generating drill cuttings.

During operation of the drilling device a first stream of produced fluid, for example liquid or gaseous hydrocarbon and/or water, flows directly to the surface through the hydrocarbon fluid production conduit. A second stream of produced fluid is pumped over the cutting surfaces of the drilling device, using a remotely controlled electrically operated pumping system which is part of the RODD, to cool the cutting surfaces and to transport drill cuttings away from the drilling device. The pumping system of the RODD allows for reverse circulation to be used. The drill cuttings are drawn into the RODD by the pump, such as a suction pump, via the bit, where they then travel in circulating channels up through the RODD and into the umbilical and are then discharged into the main wellbore. From the main wellbore the drill cuttings can be transported up the production conduit by fluid flowing in the main wellbore.

The new wellbore section that is drilled may be:

(a) a wellbore extending into the hydrocarbon fluid bearing zone of the formation from a selected location immediately above the zone;

(b) a continuation of an existing wellbore that penetrates the hydrocarbon fluid bearing zone of the formation;

(c) a side-track well from a selected location in the production tubing or a selected location in the existing wellbore below the producing tubing;

(d) a lateral well from a selected location in the production tubing and/or a selected location in the existing wellbore below the production tubing; or (e) a lateral exploration well from a selected location in the production tubing and/or a selected location in the existing wellbore below the production tubing.

Where the side-track well drilled is a branch of an existing wellbore that is no longer producing hydrocarbon fluid, the existing wellbore can be sealed below the selected location from which the side-tracked well is be drilled. A plurality of lateral wells may be drilled from either the same location in the existing wellbore, i.e. in different radial directions, and/or from different location in the existing wellbore, i.e. at different depths.

The existing wellbore can have a casing and a hydrocarbon fluid protection conduit arranged in a sealing relationship with the wall of the casing. The casing may run from the surface to the bottom of the existing wellbore. Alternatively the casing may run from the surface into the upper section of the existing wellbore with the lower section comprising a barefoot or open hole completion. When the selected location for further drilling lies below the production conduit the borehole formed by the drilling device may be a window in the casing. If the selected location lies within the production conduit then the further borehole formed may be a window through the production conduit and through the casing of the wellbore.

Preferably the drilling device is provided with an electrically operated steering means, for example a steerable joint, which is used to adjust the trajectory of the new wellbore section being drilled. The steering means is electrically connected to operating equipment at the water's surface via an electrical conductor wire or a segmented conductor embedded in the wireline cable. As the casing of the existing wellbore may be formed from metal and the RODD may be required to drill through the casing, the cutting surfaces on the drilling device may need to be capable of milling a window through the casing by grinding or cutting metal. The drilling device is preferably provided with an expandable cutting surface, i.e. an expandable or bi-centre drill bit to allow the wellbore that is drilled in the existing wellbore to be of a larger diameter than the inner diameter of the SCG and production conduit. The drilling device may also be provided with formation sensors which are electrically connected to recording equipment mounted in the vessel at the water's surface via an electrical conductor wire(s) or segmented conductor(s) in the cable.

The cable that the drilling device is suspended from is preferably formed from reinforced steel, and is preferably connected to the drilling device by a releasable connector. The cable can encase one or more wires or segmented conductors for transmitting electricity or electrical signals. The cable may be a modified cable comprising a core of an insulation material having at least one electrical conductor wire or segmented conductor therein, an intermediate fluid barrier layer, preferably comprises of steel, and an outer flexible protective sheet, preferably steel braiding. The electrical conductor wires and/or segmented conductor embedded in the core of the insulation material are preferably coated with an electrical insulation material.

When the borehole formed by the drilling device comprises a new section of wellbore it is preferred that the wireline cable from which the drilling device is suspended lies within a length of the production tubing so that top end of the umbilical also lies within the production tubing. The interior of the umbilical is in fluid communication with a fluid passage in the drilling device. The drilling device can be attached either directly or indirectly to the umbilical. The umbilical extends from the drilling device along at least a lower section of the cable. Preferably the umbilical extends into the hydrocarbon fluid production conduit; therefore preferably the length of the umbilical is at least as long as the desired length of the new wellbore section.

Figure 6:
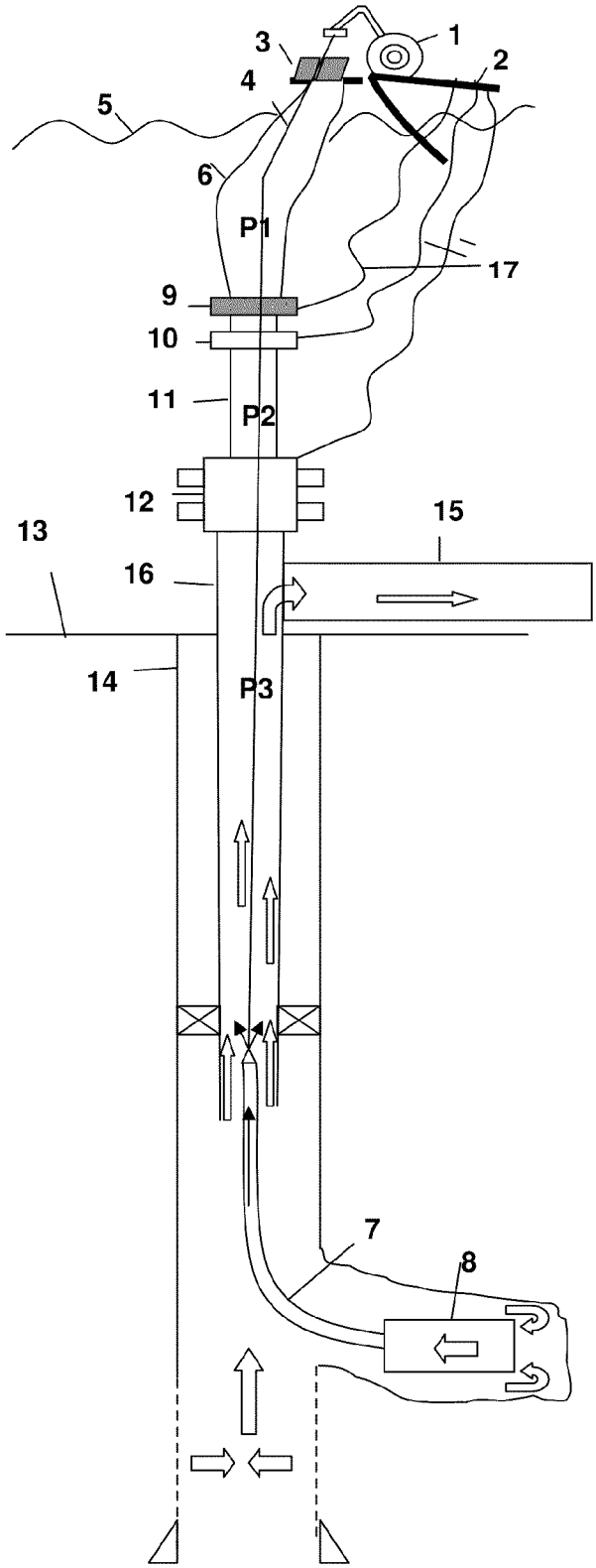

FIG. 6 shows the flow of production fluid and cuttings during drilling of the lateral borehole from the main wellbore. Cuttings are transported uphole using the reverse circulation mechanism of the RODD 8. These cuttings enter the RODD through the bit and travel inside the RODD circulating channels and up into the umbilical. Once they reach the end of the umbilical they exit the umbilical and are carried uphole by the production fluid from the main borehole, into the production line 15 which conducts the production fluid to a production facility with fluids/solids separation capabilities.

Figure 7:
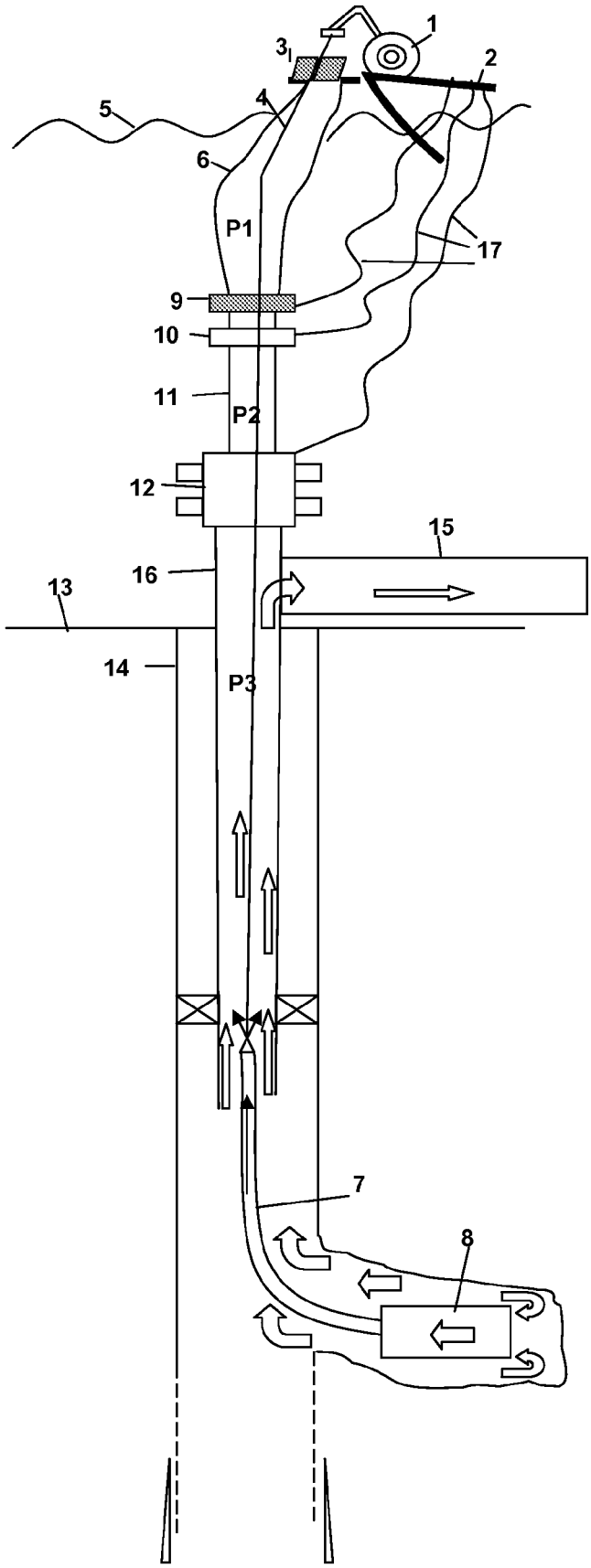

Alternatively if the main borehole is not producing any fluids then the flow from the hydrocarbon and/or water production coming from the lateral borehole being drilled will carry the cuttings to the surface via the production line 15 as shown in FIG. 7.

Figure 8:
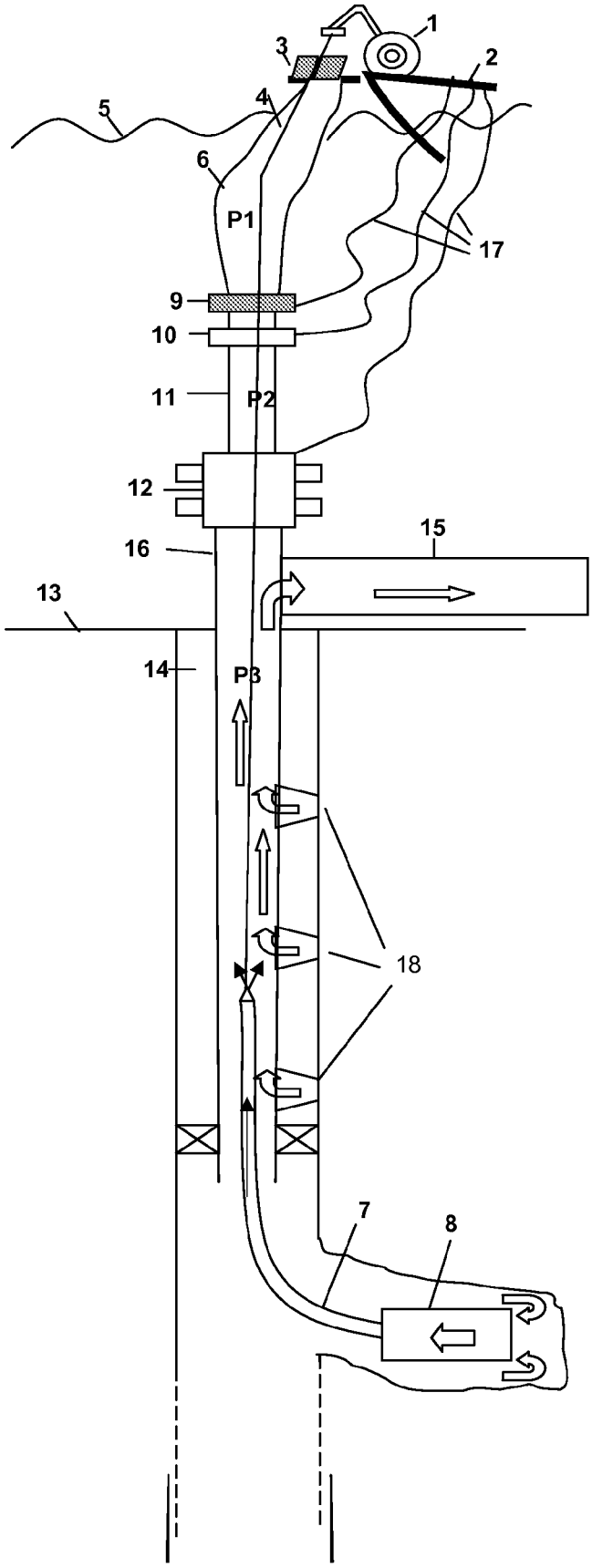
Figure 9:
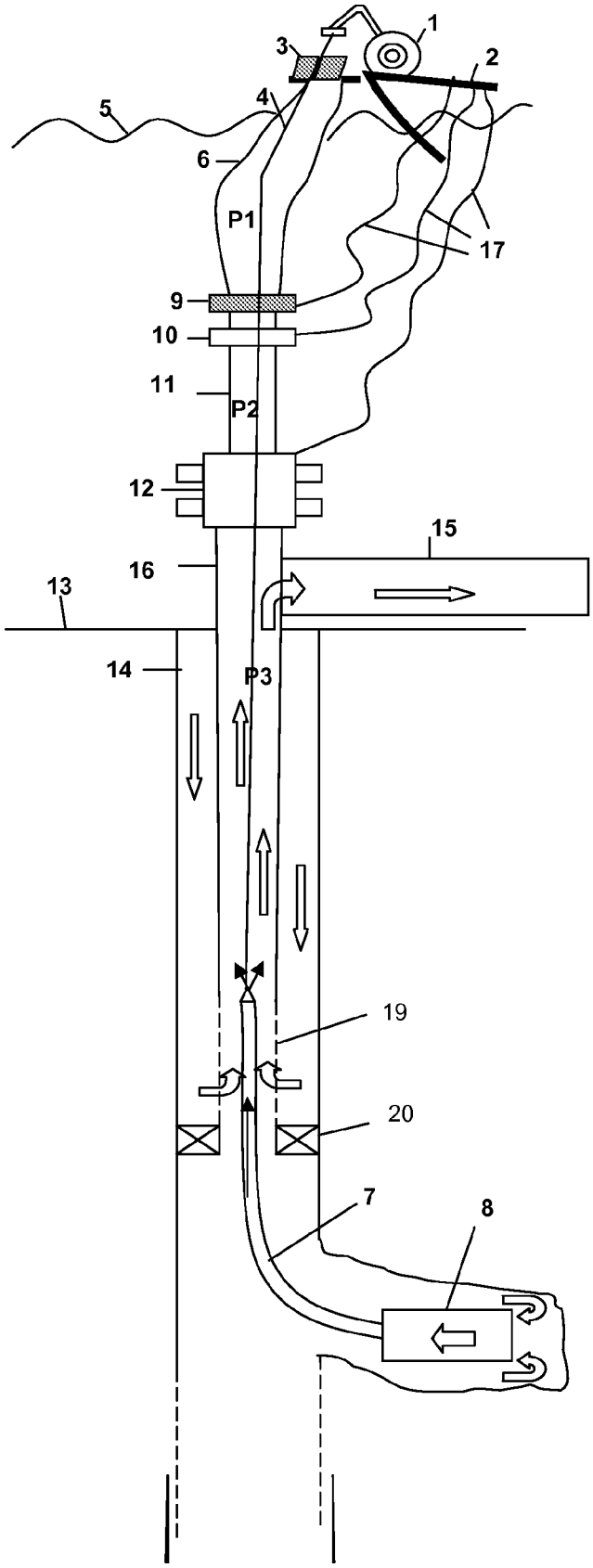

If no natural flow exists during the drilling process then fluid flow can be generated by artificial lift methods such as gas lift mandrels 18 in the production tubing, see FIG. 8. The deepest gas lift mandrel is positioned below where the top of the umbilical will reach such that the flow generated by these mandrel will lift the cuttings being ejected from the umbilical that have flown through the reverse circulation process of the RODD, up through the production tubing into the production line.

An alternative process if no natural flow exists is having perforations 19 in the production tubing. The perforations are made at such a depth that they always remain below the top of the umbilical. If access is possible to the annular space between the production tubing and the casing which are in sealing relationship due to a packer 20 positioned between the production tubing and casing then fluid can be pumped down this annular space. The fluid then flows from the annular space through the perforations up into the production tubing string, so that the fluid acts as a carrying fluid for the produced cuttings being ejected from the top of the umbilical (see FIG. 9).

The fluid flow carrying the entrained cuttings is carried via the production line 15 onwards to the production facility where the solids can be removed from the production fluid using conventional cutting separation techniques, such as using a hydrocyclone or others means for separating solids from a fluid stream.

Figure 10:
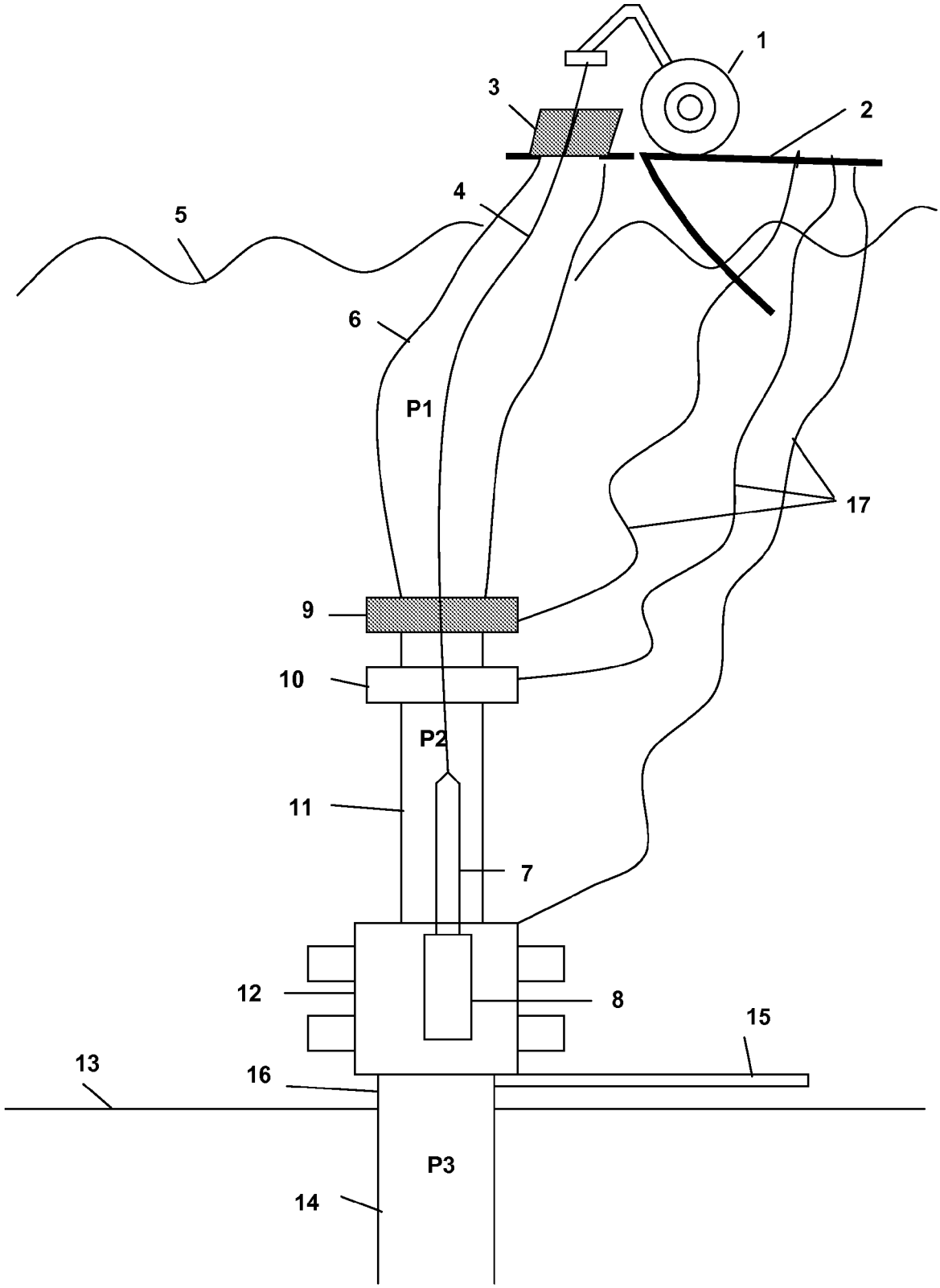
Figure 11:
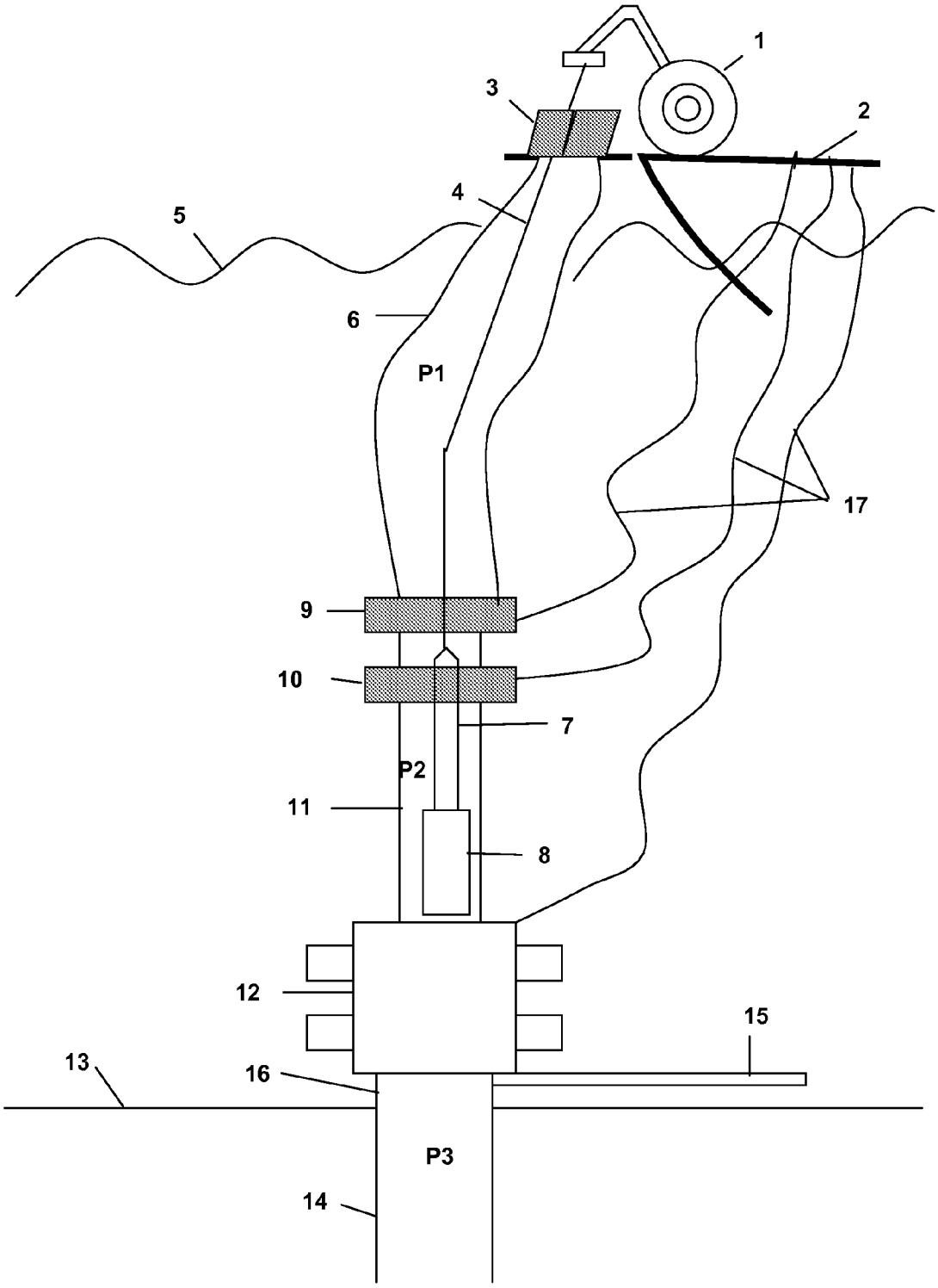
Figure 12:
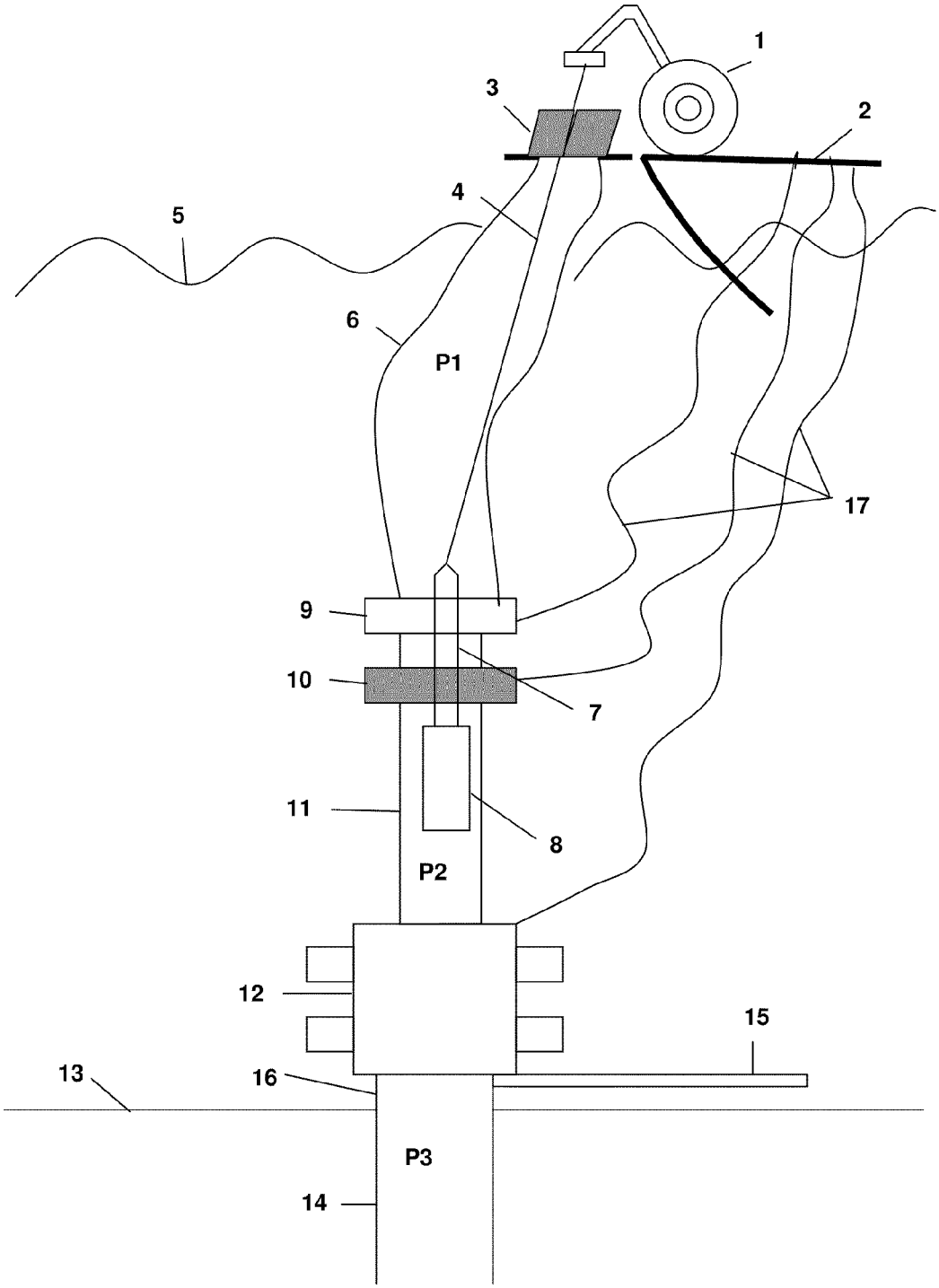
Figure 13:
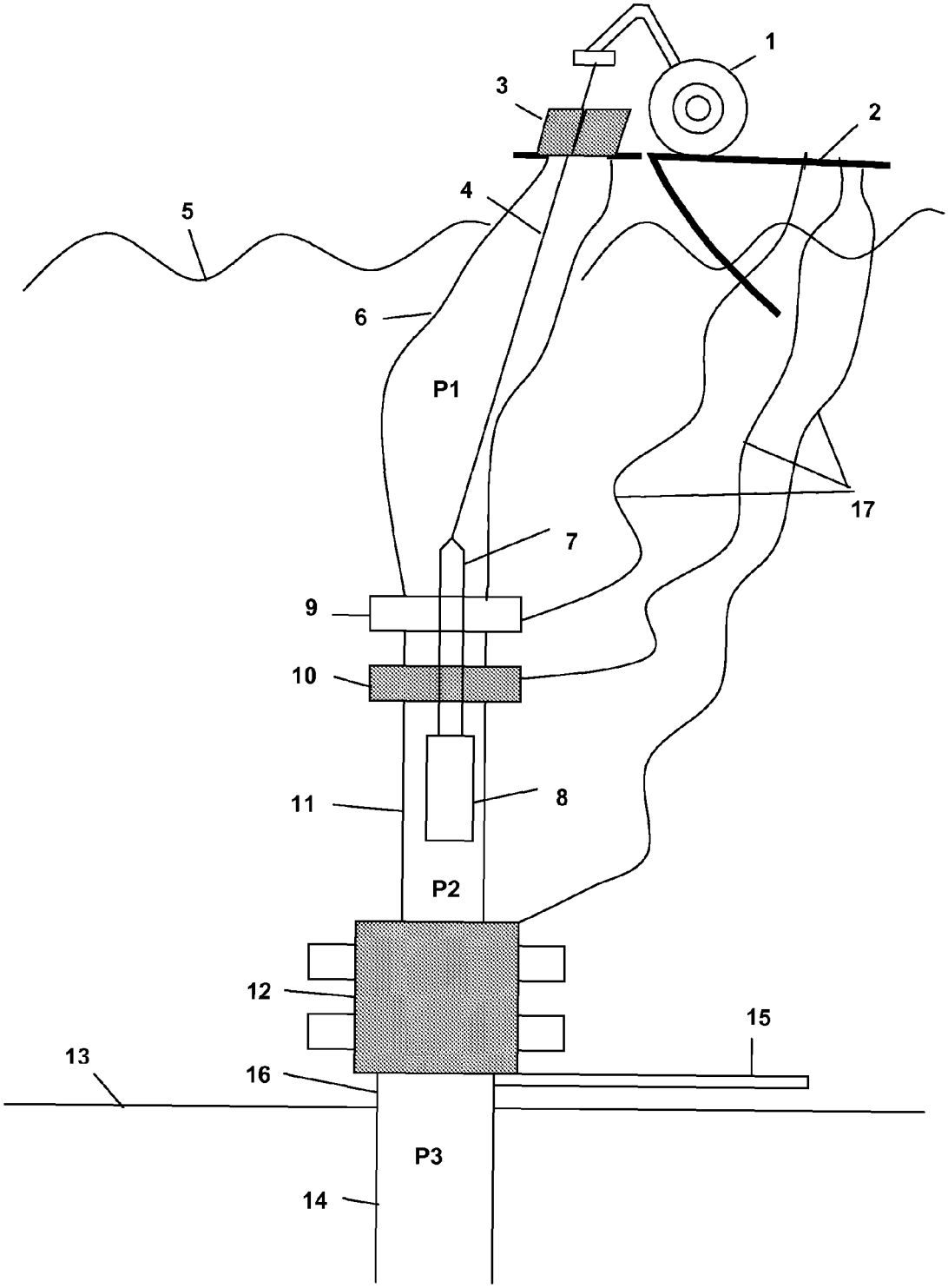
Figure 14:
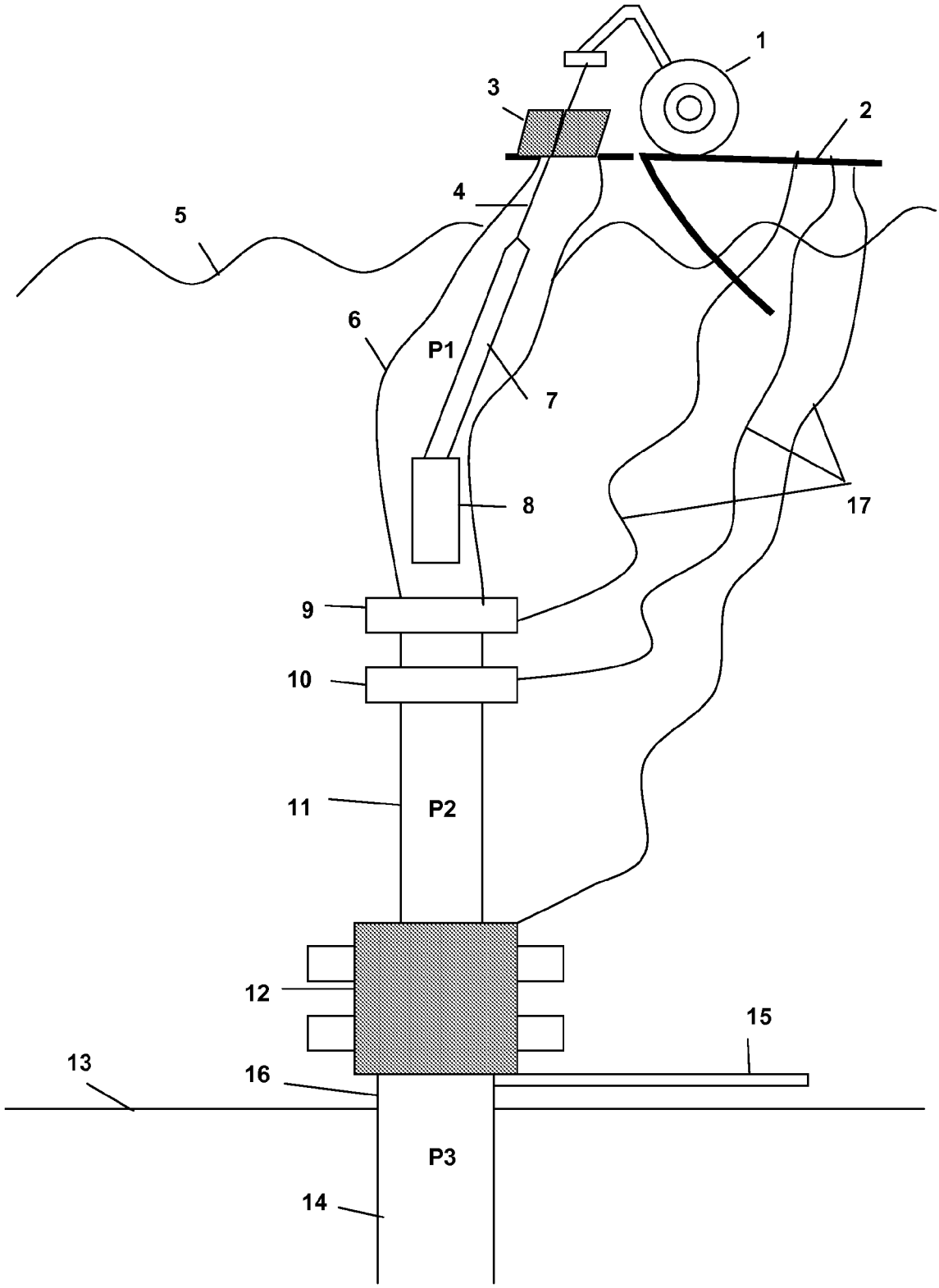

Once the drilling process is finished the RODD/umbilical and wireline assembly is pulled out of the wellbore using a wireline winch and/or a RODD crawling mechanism (see FIG. 10). When the top of the umbilical reaches stuffing box 10, see FIG. 11, the stuffing box 10 is operated using one of control lines 17 so that a seal is created about the umbilical. Once this seal is confirmed stuffing box 9 is operated using a control line 17 and the existing seal against the wireline cable is relieved (see FIG. 12).

Figure 15:
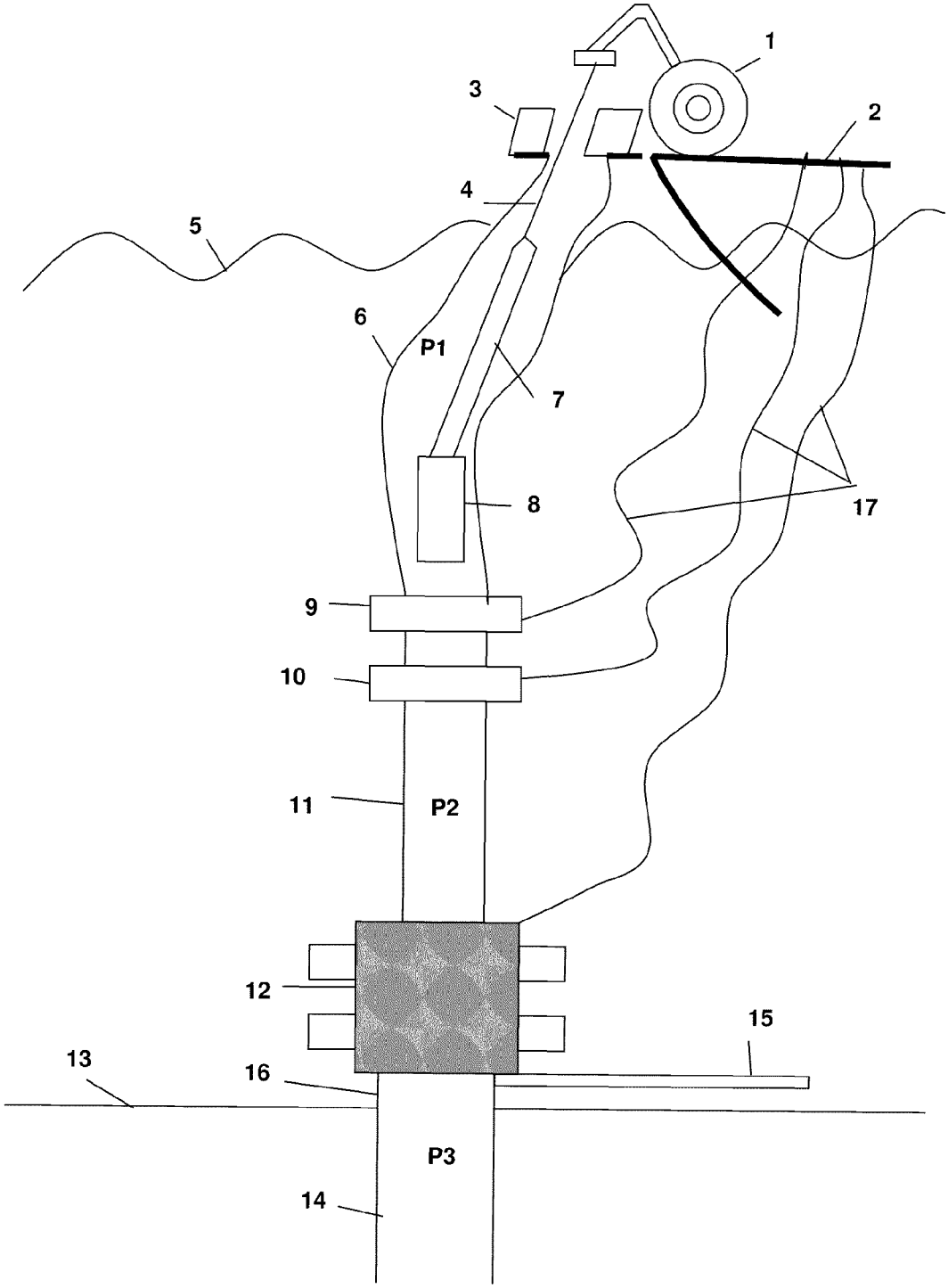

Throughout the pulling process as the RODD assembly is removed from the well the pressure P1 is always kept slightly higher than the pressures P2 and P3 to ensure no fluids can enter the SCG or flexible riser. The RODD/umbilical and wireline cable assembly continues to be pulled out of the well until the RODD exits the SSBOP or well intervention package. At this stage the SSBOP or well intervention package are closed to prevent any flow from the well entering the lubricator (see FIG. 13). It is then confirmed that the internal pressure, P1, in the SCG or flexible riser is higher than that of the lubricator, P2, and then stuffing box 10 is operated using a control line 17 to relieve the seal against the umbilical, see FIG. 14. Pressure P2 and P1 are equalized and then relieved using surface valves. Surface stuffing box 3 is then operated to relieve the seal against the wireline (see FIG. 15). The RODD/umbilical and wireline cable are then raised onto the floating platform.

The embodiments described above are only examples. Various elements of the system and process can be modified while still remaining within the scope of the invention.

The invention claimed is:

1. A method for drilling a borehole in a producing subsea wellbore wherein a flexible conduit is connected at one end to a surface vessel and at the other end via a pressurized subsea wellhead to the producing subsea wellbore such that a remotely operated electrical drilling device (RODD) can be deployed down the flexible conduit, wherein the flexible conduit is attached to a lubricator that is connected to the pressurized subsea wellhead, the method comprising the steps of:

directing the RODD to a location for drilling in the producing subsea wellbore;

wherein the directing step comprises regulating a pressure inside the flexible conduit to be greater than a pressure inside the lubricator while maintaining the pressure inside the lubricator substantially the same as a pressure at the pressurized subsea wellhead such that the RODD is lowered into the producing subsea wellbore without injection; and drilling a further wellbore section with the RODD;

wherein the drilling step comprises drilling in underbalanced conditions with respect to a formation; and using fluids produced from the formation to transport drill cuttings away from the RODD.

2. A method according to claim 1 further comprising pumping produced fluids over cutting surfaces of the RODD and into an inside of the RODD.

3. A method according to claim 1 further comprising lowering the RODD down the flexible conduit into the producing subsea wellbore.

4. A method according to claim 1 further comprising lowering the RODD from the pressurised subsea wellhead into the producing subsea wellbore.

5. A method according to claim 1 further comprising deploying the RODD from a light intervention vessel.

6. A method according to claim 1, wherein the flexible conduit is a spoolable compliant guide (SCG).

7. A method according to claim 1, wherein the flexible conduit is a flexible riser.

8. A system for performing the method according to claim 1, comprising:

a flexible conduit connectable at one end to a surface vessel and at the other end to a subsea installation; and a remotely operated electrical drilling device (RODD) capable of being inserted down the flexible conduit into an existing subsea wellbore for further drilling of the subsea wellbore;

wherein the RODD is attached to an umbilical and wireline assembly;

wherein the surface vessel comprises a stuffing box capable of sealing the wireline;

wherein the flexible conduit is attached to a lubricator that is connected to the subsea installation, said lubricator comprising a first stuffing box capable of sealing the wireline and a second stuffing box capable of sealing the umbilical; wherein said stuffing boxes facilitate regulation of a pressure inside the flexible conduit and a pressure inside the lubricator.

9. A system according to claim 8, wherein the flexible conduit is a flexible riser.

10. A system according to claim 8, wherein the flexible conduit is a spoolable compliant guide (SCG).

11. A system according to claim 8, wherein the RODD comprises a pump for pumping fluids produced from a formation over cutting surfaces of the RODD and into an inside of the RODD.

12. A system according to claim 8, wherein the surface vessel is a light intervention vessel.

* * * * *